United States Patent [19]

Rojas

[11] Patent Number: 4,981,214

[45] Date of Patent: Jan. 1, 1991

[54] BEVERAGE CONTAINER ASSEMBLY

[76] Inventor: Albert R. Rojas, 499 Via Colinas, Westlake Village, Calif. 91362

[21] Appl. No.: 251,329

[22] Filed: Sep. 30, 1988

[51] Int. Cl.[5] ..... B65D 65/00

[52] U.S. Cl. ..... 206/430; 206/509

[58] Field of Search ..... 206/809, 430, 23.6

[56] References Cited

U.S. PATENT DOCUMENTS 4,373,633 2/1983 Lutz, Sr. ..... 206/809

4,489,839 12/1984 Epperson ..... 206/809

4,640,423 2/1987 Mednis ..... 206/509

4,708,253 11/1987 Mednis ..... 206/509

4,768,672 9/1988 Pulciani et al. ..... 206/509

*Primary Examiner*—Joseph Man-Fu Moy

[57] ABSTRACT

A beverage container assembly composed of two identical bevrage containers which are connected together at their bottoms into a single unit. The beverage containers are identical. The beverage containers can be manually separated and the contents of the beverage containers to be consumed individually.

4 Claims, 1 Drawing Sheet

BEVERAGE CONTAINER ASSEMBLY

BACKGROUND OF THE INVENTION

The field of this invention relates to food products and more particularly to the constructing of an enclosed container which is particularly adapted to contain a beverage.

The use of metallic containers which contain pressurized contents of a liquid are well-known. Soda and beer are commonly sold in such containers. The most prevalent size of such container contains twelve ounces of the beverage. To many people, to consume twelve ounces of liquid within a few minutes time is excessive. If the contents of the container is not consumed within a few minutes, either the beverage container will become warm (if it has been cold) or the pressurizing of the beverage will dissipate with the result that the contents will become "flat". For many people, in order to prevent the contents from becoming heated while saving the remainder of the contents for consumption at a later time, the beverage can is placed within a refrigerator. However, because the beverage container has been opened, the container will then become "flat" as it will lose its carbonation.

SUMMARY OF THE INVENTION

The structure of this invention is directed to constructing of a beverage container in the size of a normal twelve ounce beverage container, but which is acutally constructed of two identical beverage containers located in a bottom abutting relationship with the separate beverage containers located in-line with each other The bottom of each beverage container includes a single ridge of approximately one hundred eighty degrees. The remaining one hundred eighty degrees includes a dual ridge with a gap therebetween. A ridge of another beverage container is to be slipped into the gap area in the dual ridges with the result that the ridge of the first mentioned beverage container fits within the gap area of the second beverage container. In this manner, the two beverage containers are secured together in an in-line manner and can be handled as though it was a single twelve ounce container. However, when it comes to consumption, the consumer can consume only six ounces of the beverage container with the remaining six ounces being saved in an unopened state to be consumed at a later time. The beverage container that was consumed could be discarded, or the consumed beverage container can remain with the unopened container.

The primary objective of the present invention is to divide the conventional twelve ounce beverage container into two separate six ounce containers which can be individually consumed at different time periods with the opening of one of the beverage container not affecting the other beverage container.

Another objective of the present invention is to construct a simple and inexpensive way to secure together the two separate beverage containers so that the resultingly formed dual beverage container assembly can be manufactured at only a slight increase in cost over the manufacturing of the single twelve ounce beverage container.

DETAILED DESCRIPTION OF THE SHOWN EMBODIMENT

Figure 1:
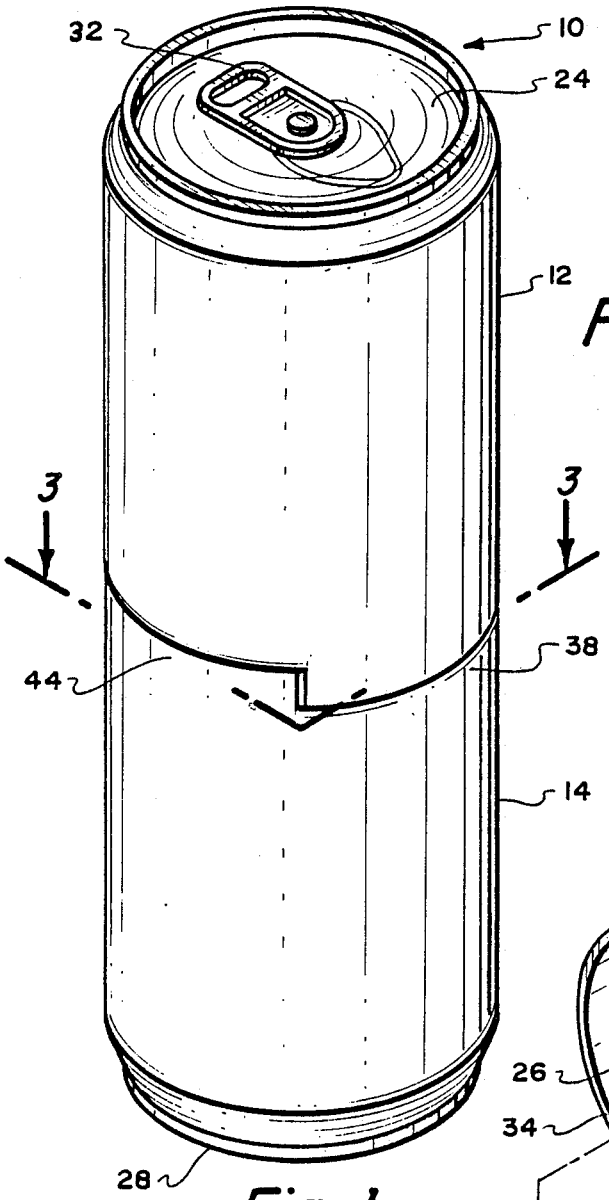
FIG. 1 is an isometric view of the beverage container assembly constructed in accordance of this invention showing the assembly in the assembled state.
Figure 3:
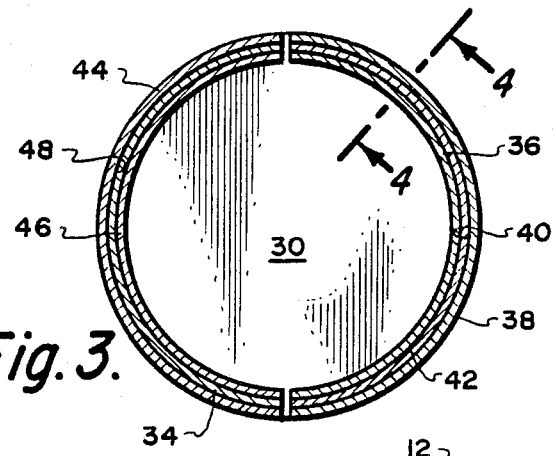
FIG. 3 is a transverse cross-sectional view through the beverage container assembly of the present invention taken along line 3—3 of FIG. 1.
Figure 4:
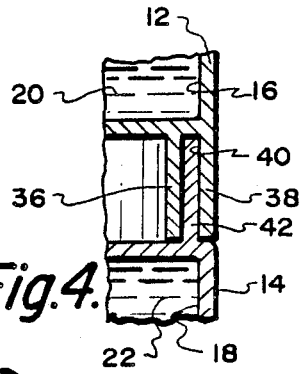
FIG. 4 is a longitudinal cross-sectional view through a portion of the beverage container assembly of the present invention taken along line 4—4 of FIG. 3.
Figure 2:
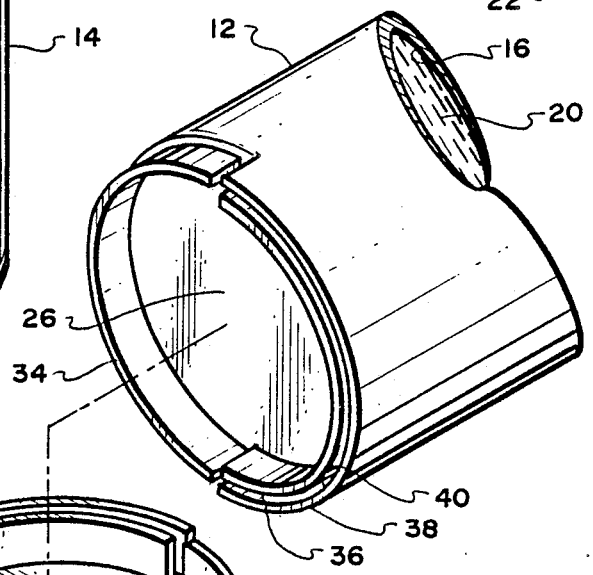
FIG. 2 is a view showing the separate beverage containers of the beverage container assembly located in a spaced apart manner depicting connecting together of the separate beverage containers.
Figure 2:
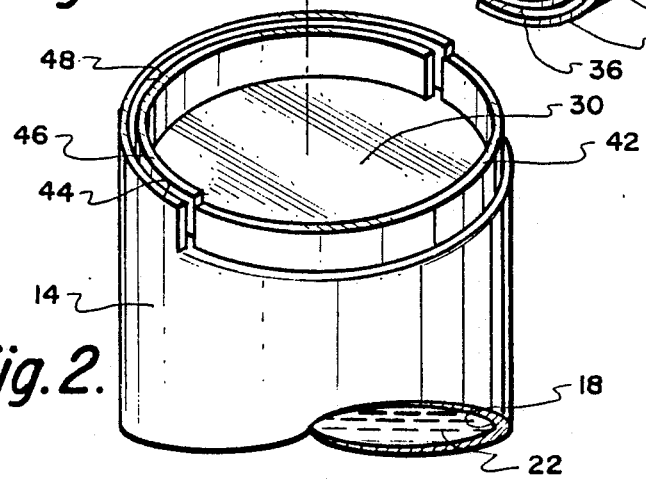

Referring particularly to the drawing there is shown the beverage container assembly 10 of this invention which is composed of a first beverage container 12 and a second beverage container 14. Each of the beverage containers 12 and 14 are constructed of a rigid wall material with generally a metal such as aluminum being preferred. The beverage container 12 has an interior chamber 16 with the beverage container 14 having an interior chamber 18. Within interior chamber 18 is located a quantity 20 of a beverage. Generally, the same identical beverage 22 will be located within the interior chamber 18.

The first beverage container 12 has a top 24 and a bottom 26. In a similar manner, the second beverage container 14 has a top 28 and a bottom 30. The beverage containers 12 and 14 are identical in construction. Within the top 24 is located a snap-tab opener 32. It is understood that within the top 28 there will also be a similar snap-tab 32. The snap-tab 32 is to be used in a conventional manner to provide access into the beverage container 12 with a similar snap-tab to be used to gain access into the beverage container 14. The beverage containers 12 and 14 are to be secured together forming a single unitary container prior to usage. These connecting together of containers 12 and 14 are at the bottoms 26 and 30. The bottom 26 includes a half-circular single ridge 34 and a pair of dual ridges 36 and 38. Between the dual ridges 36 and 38 is located a gap area 40. The single ridge 34 is concentric with the gap area 40.

The second beverage container 14, in a similar manner has a single ridge 42 and a pair of dual ridges, concentrically located, 44 and 46. Between the dual ridges 44 and 46 is located a gap area 48. The length of the dual ridges 44 and 46 is substantially half-circular with the single ridge 42 also being half-circular.

With the first beverage container 12 mounted in an in-line connection with the second container 14, the single ridge 34 extends in a snug fitting manner within the gap area 48. At the same time, the single ridge 42 is located in a snug-fitting manner within the gap area 40. In essence, the two individual beverage containers 12 and 14 are now secured together forming a single container even though there are actually two separate containers 12 and 14.

It is to be understood that the beverage containers 12 and 14 can be manually disengaged from one another and can be re-engaged if such is deemed to be desirable. Normal practice would be to separate the beverage containers 12 and 14 prior to consumption of any one of the containers.

What is claimed is:

1. A beverage container assembly comprising:

a first normally closed beverage container, said first normally closed beverage container having a first top and a first bottom, said first top including first opening means operable to gain access into said first normally closed beverage container;

a second normally closed beverage container, said second normally closed beverage container having a second top and a second bottom, said second top including second opening means operable to gain access into said second normally closed beverage container; and said first bottom including first connecting means integrally formed on said first bottom, said second bottom including second connecting means integrally formed on said second bottom, said first and second connecting means to matingly engage forming a single beverage container composed of said first normally closed beverage container and said second normally closed beverage container located in an in-line longitudinal alignment.

2. The beverage container assembly as defined in claim 1 wherein:

said first normally closed beverage container being identical to said second normally closed beverage container.

3. The beverage container assembly as defined in claim 2 wherein:

both said first and second connecting means each including a single ridge and a dual ridge with a gap therebetween, said ridge of said first connecting means to be located within said gap of said second connecting means with said ridge of said second connecting means to be located within said gap of said first connecting means to thereby secure together into a single unit said first and second beverage containers.

4. The beverage container assembly as defined in claim 3 wherein:

said first normally closed beverage container being cylindrical, said second normally closed beverage container being cylindrical.

* * * * *